US009371975B2

(12) United States Patent
Ye et al.

(10) Patent No.: US 9,371,975 B2
(45) Date of Patent: Jun. 21, 2016

(54) LIGHT SOURCE DEVICE

(71) Applicant: Formosa Epitaxy Incorporation, Taoyuan County (TW)

(72) Inventors: Zhi-Ting Ye, Taoyuan County (TW); Fen-Ren Chien, Taoyuan County (TW)

(73) Assignee: Formosa Epitaxy Incorporation, Taoyuan (TW)

( * ) Notice: Subject to any disclaimer, the term of this patent is extended or adjusted under 35 U.S.C. 154(b) by 35 days.

(21) Appl. No.: 14/487,107

(22) Filed: Sep. 16, 2014

(65) Prior Publication Data

US 2015/0211690 A1 Jul. 30, 2015

Related U.S. Application Data

(60) Provisional application No. 61/931,695, filed on Jan. 27, 2014.

(51) Int. Cl.

| | |
|---|---|
| ***F21V 5/04*** | (2006.01) |
| *F21S 6/00* | (2006.01) |
| *F21W 131/103* | (2006.01) |
| *F21Y 101/02* | (2006.01) |

(52) U.S. Cl.

CPC .. *F21V 5/04* (2013.01); *F21S 6/003* (2013.01); *F21W 2131/103* (2013.01); *F21Y 2101/02* (2013.01)

(58) Field of Classification Search

CPC ..... F21S 6/003; F21W 2131/103; F21V 5/04
USPC ..... 362/311.02
See application file for complete search history.

(56) References Cited

U.S. PATENT DOCUMENTS

| | | | | |
|---|---|---|---|---|
| 6,997,580 | B2 * | 2/2006 | Wong | H01L 33/54 257/98 |
| 7,474,475 | B2 * | 1/2009 | Paek | G02B 6/0018 359/726 |
| 7,950,831 | B2 * | 5/2011 | Moon | H01L 33/54 362/235 |
| 2010/0073937 | A1 * | 3/2010 | Ho | F21V 5/04 362/335 |
| 2010/0328940 | A1 * | 12/2010 | Huang | F21S 8/086 362/235 |
| 2014/0056007 | A1 * | 2/2014 | Chou | F21V 13/04 362/308 |
| 2014/0119018 | A1 * | 5/2014 | Tseng | F21V 5/04 362/268 |

FOREIGN PATENT DOCUMENTS

| | | |
|---|---|---|
| TW | 201135983 | 10/2011 |

OTHER PUBLICATIONS

"Office Action of Taiwan Counterpart Application", issued on Nov. 17, 2015, p. 1-p. 4.

* cited by examiner

*Primary Examiner* — Laura Tso
(74) *Attorney, Agent, or Firm* — Jianq Chyun IP Office

(57) ABSTRACT

A light source device including a light emitting diode (LED) chip and a molding lens is provided. The molding lens is directly formed on the LED chip and includes a center of a bottom where the LED chip located at and a light exiting surface formed corresponding to the center. The light exiting surface comprises a concave portion, a first light exiting region surrounding the concave portion and a second light exiting region surrounding the first light exiting region. The first light exiting region connects between the concave portion and the second light exiting region.

16 Claims, 10 Drawing Sheets

LIGHT SOURCE DEVICE

CROSS-REFERENCE TO RELATED APPLICATION

This application claims the priority benefits of U.S. provisional application Ser. No. 61/931,695, filed on Jan. 27, 2014. The entirety of the above-mentioned patent application is hereby incorporated by reference herein and made a part of this specification.

BACKGROUND OF THE INVENTION

1. Field of the Invention

The present invention generally relates to a light source device. More particularly, the present invention relates to a light source device having a molding lens.

2. Description of Related Art

In the recent years, along with the progression of semiconductor technology, light emitting diode (LED) is able to emit light beam having high luminous intensity, and the luminous efficiency of the LED is constantly improved. Compared to some conventional light sources, the LED light source has the advantages of energy efficient, small size and long life expectancy. Therefore, the conventional light sources are gradually replaced with the LED light source, and the LED light source is widely applied in the field of lighting, such as car headlights, street lamps, desk lamps, etc.

The LED light sources used for illumination generally has an angle of half maximum power that is approximately 120 degrees, and the luminous intensity of the LED at the forward direction substantially perpendicular to the light-emitting surface is higher while that at the oblique direction oblique to the forward direction is weaker. In other words, the light emitted by the LED has a Lambertian distribution. Therefore, if the LED light source is directly applied in a conventional light bulb without any modification, the light emission angle of the light bulb having the LED light source would be restricted, and particularly, the light intensity at a side oblique to the light-emitting side of the light source is even weaker. In order to increase the light emission angle of the lamp, some LED light bulbs are incorporated with a lamp housing having the scattering effect. By such lamp housing, the light intensity in the direction oblique to the light-emitting side of the LED light bulb may be increased. However, it is still not enough to meet the requirement of the omni-directional lighting.

SUMMARY OF THE INVENTION

Accordingly, the present invention is directed to a light source device which is able to provide omni-directional lighting.

The present invention provides a light source device. The light source device includes a light emitting diode (LED) chip and a molding lens. The molding lens is directly formed on the LED chip and includes a center of a bottom where the LED chip located at and a light exiting surface formed corresponding to the center. The light exiting surface comprises a concave portion, a first light exiting region surrounding the concave portion and a second light exiting region surrounding the first light exiting region. The first light exiting region connects between the concave portion and the second light exiting region.

According to an embodiment of the present invention, the concave portion includes a cone-shaped recess. An apex of cone-shaped recess points toward the LED chip.

According to an embodiment of the present invention, a vertex angle of the cone-shaped recess ranges from 45 degree to 150 degree.

According to an embodiment of the present invention, a vertex angle of the cone-shaped recess ranges from 70 degree to 120 degree.

According to an embodiment of the present invention, the concave portion includes a first V-shaped valley including a first flat surface and a second flat surface connected to each other in a non-coplanar manner, and a vertex angle is formed between the first flat surface and the second flat surface in cross section view.

According to an embodiment of the present invention, the vertex angle ranges from 45 degree to 150 degree.

According to an embodiment of the present invention, the vertex angle ranges from 70 degree to 120 degree.

According to an embodiment of the present invention, the vertex angle includes a first vertex angle formed between the first flat surface and a vertical plane, and a second vertex angle formed between the second flat surface and the vertical plane.

According to an embodiment of the present invention, the concave portion is symmetric corresponding to the center of the bottom, and the degree of the first vertex angle is equal to the degree of the second vertex angle.

According to an embodiment of the present invention, the concave portion is asymmetric corresponding to the center of the bottom, and the degree of the first vertex angle is different from the degree of the second vertex angle.

According to an embodiment of the present invention, the first vertex angle ranges from 20 degree to 75 degree.

According to an embodiment of the present invention, the first vertex angle is substantially equal to 45 degree.

According to an embodiment of the present invention, the second vertex angle ranges from 20 degree to 75 degree.

According to an embodiment of the present invention, the second vertex angle is substantially equal to 70 degree.

According to an embodiment of the present invention, the concave portion further includes a second V-shaped valley intersected with the first V-shaped valley.

According to an embodiment of the present invention, the concave portion further includes a second V-shaped valley intersected with the first V-shaped valley.

According to an embodiment of the present invention, the shape of the first V-shaped valley is different from the shape of the second V-shaped valley.

According to an embodiment of the present invention, the distance between the center of the bottom and the light exiting surface from one end where the first light exiting region connects to the concave region to another end where the first light exiting region connects the second light exiting region is increasing smoothly and gradually.

According to an embodiment of the present invention, an included angle formed from the center of the bottom corresponding to one end where the first light exiting region connects to the concave region and another end where the first light exiting region connects to the second light exiting region ranges from 3 degree to 70 degree.

According to an embodiment of the present invention, the distance between the center of the bottom and the light exiting surface from one end where the first light exiting region connects to the second light exiting region to another end where the second light exiting region connects to the bottom of the molding lens is increasing smoothly and gradually.

According to an embodiment of the present invention, the distance between the center of the bottom and the light exiting surface from one end where the first light exiting region connects to the second light exiting region to another end where the second light exiting region connects to the bottom of the molding lens is decreasing.

According to an embodiment of the present invention, the concave portion includes a valley-shaped recess in cross section view, and the valley-shaped recess includes a first curved surface and a second curved surface connected to each other in a non-coplanar manner. The first curved surface and the second curved surface protrude away from the bottom.

According to an embodiment of the present invention, the first light exiting region and the second light exiting region of the light exiting surface are vertical corresponding to the bottom of the molding lens.

According to an embodiment of the present invention, the first light exiting region and the second light exiting region of the light exiting surface are vertical corresponding to the bottom of the molding lens.

According to an embodiment of the present invention, an included angle formed from the center of the bottom corresponding to one end where the first light exiting region connects to the concave region and another end where the second light exiting region connects to the bottom of the molding lens ranges from 40 degree to 50 degree.

Based on the abovementioned description, the embodiments of the present invention provide various molding lenses with various shapes for encapsulating the LED chip of the light source device. In detail, the light exiting surface of the molding lens includes a concave portion, a first light exiting region surrounding the concave portion and a second light exiting region surrounding the first light exiting region, and the first light exiting region connects between the concave portion and the second light exiting region. The concave portion is capable of reflecting the light emitted by the LED chip to the first light exiting region and the second light exiting region. Thereby, with the disposition of the molding lens, the light source device can provide wide angle light-emitting effect and great light-emitting uniformity.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
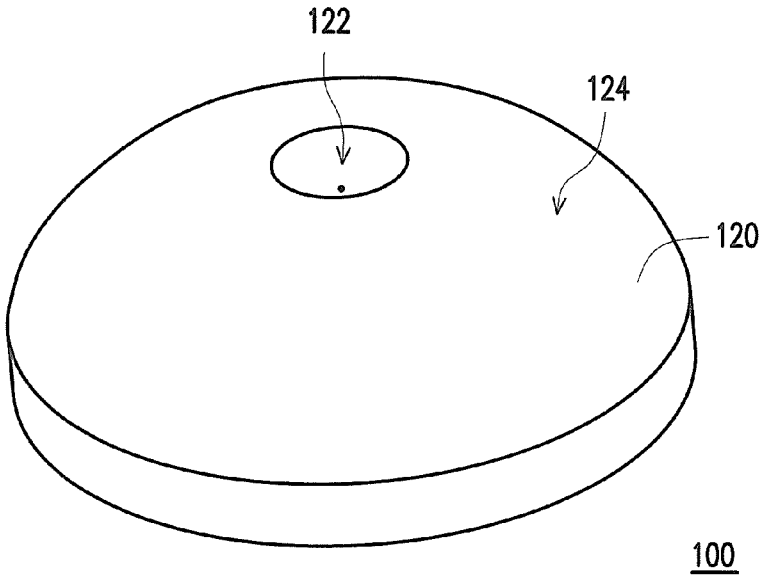
FIG. 1 illustrates a schematic view of a light source device according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
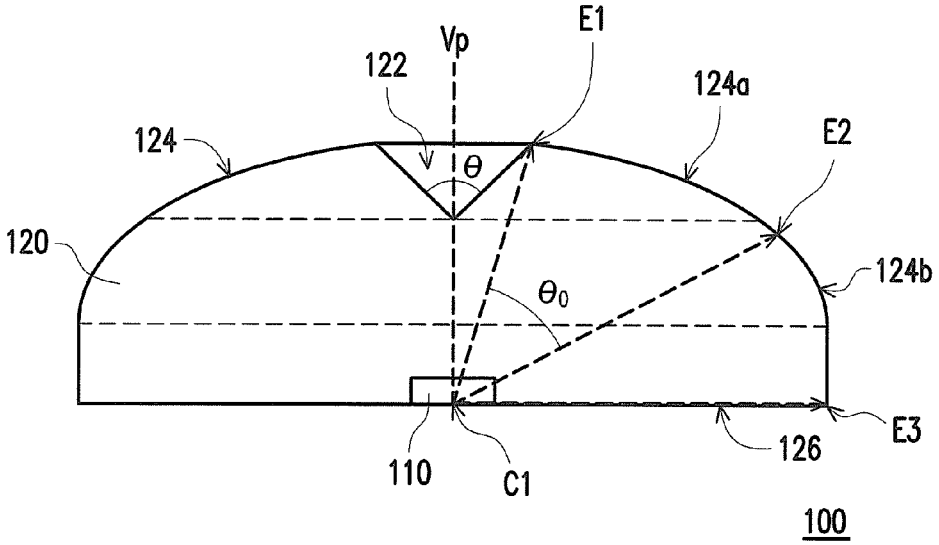
FIG. 2 illustrates a cross-sectional view of the light source device in FIG. 1.
Figure 5:
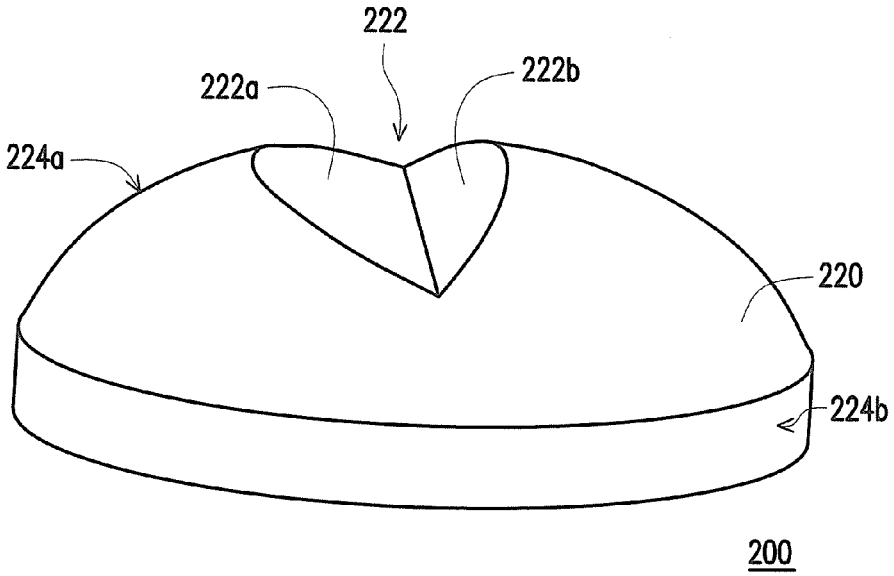
FIG. 5 illustrates a schematic view of a light source device according to an embodiment of the invention.
Figure 6:
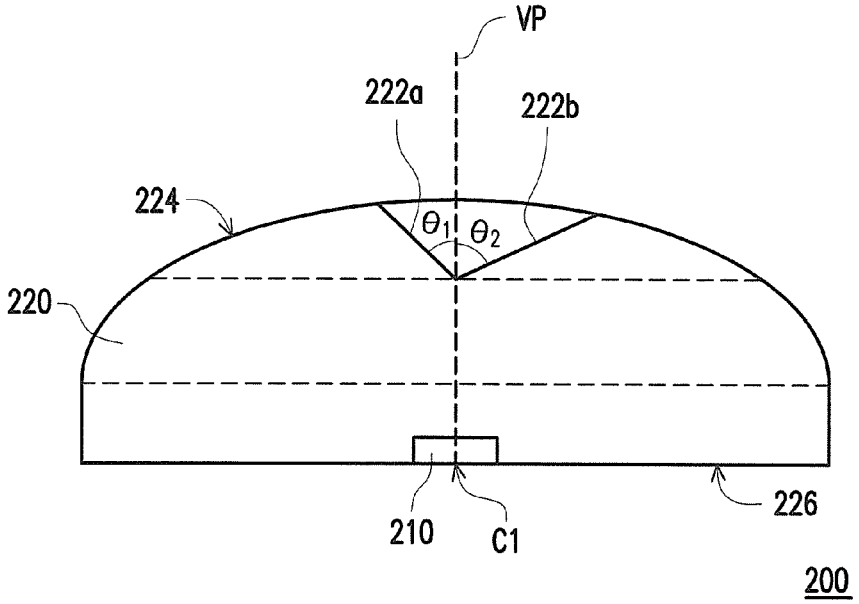
FIG. 6 illustrates a cross-sectional view of the light source device in FIG. 5.
Figure 10:
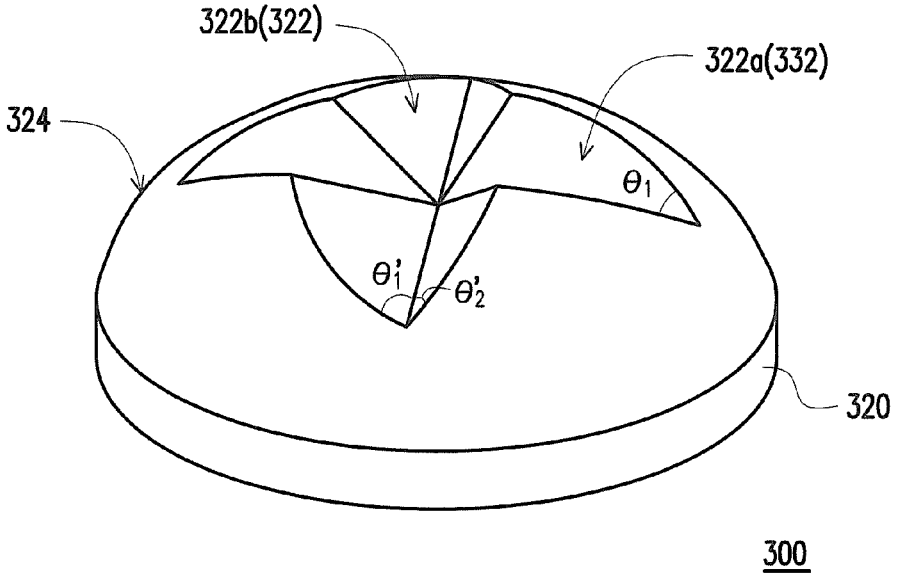
FIG. 10 illustrates a schematic view of the light source device in FIG. 9.
Figure 13:
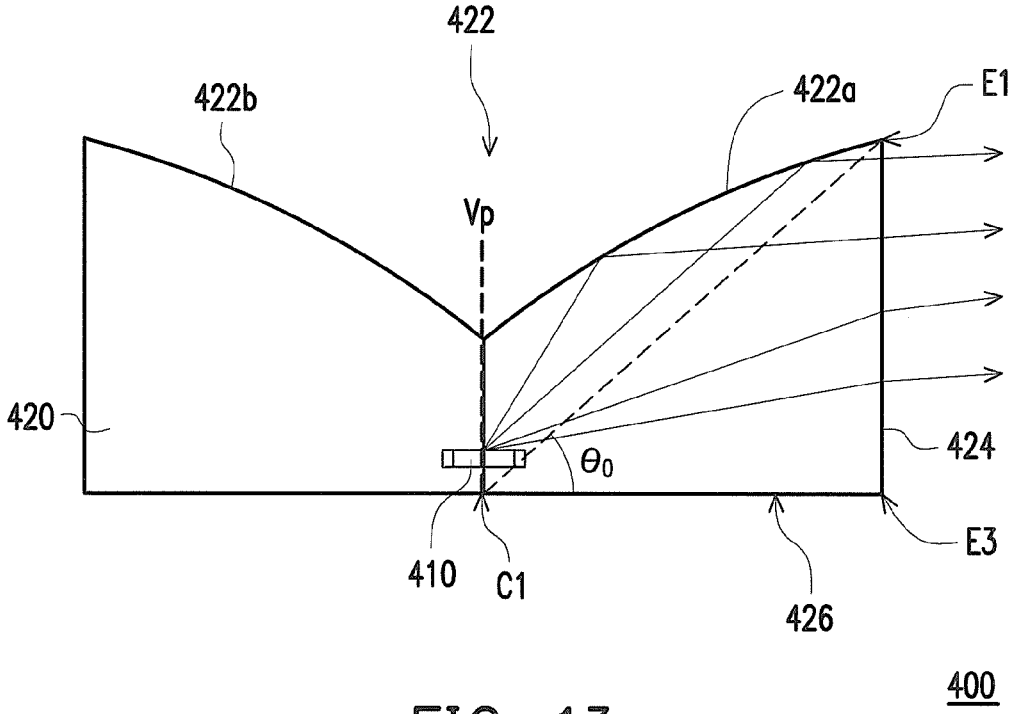
FIG. 13 illustrates a cross-sectional view of a light source device according to an embodiment of the invention.

FIG. 1 illustrates a schematic view of a light source device according to an embodiment of the invention. FIG. 2 illustrates a cross-sectional view of the light source device in FIG. 1. Referring to FIG. 1 and FIG. 2, a light source device 100 of the present embodiment includes a light emitting diode (LED) chip 110 (the light emitting chip shown in FIG. 13 is labeled as 410) and a molding lens 120. The molding lens 120 is directly formed on the LED chip 110 by insert molding or injection molding process, and includes a center C1 of a bottom 126 where the LED chip 110 located at and a light exiting surface 124 (the light exiting surface shown in FIG. 6 is labeled as 224, and the light exiting surface shown in FIG. 10 is labeled as 324) formed corresponding to the center C1. In other words, the molding lens 120 includes the bottom 126 and the light exiting surface, wherein the LED chip 110 is embedded in the molding lens 120 as shown in FIG. 2, and the location of the light exiting surface 124 corresponds to the center C1 of the bottom 126. The light exiting surface 124 includes a concave portion 122, a first light exiting region 124*a* (the first light exiting region shown in FIG. 5 is labeled as 224*a*) and a second light exiting region 124*b* (the second light exiting region shown in FIG. 5 is labeled as 224*b*). The first light exiting region 124*a* surrounds the concave portion 122, and the second light exiting region 124*b* surrounds the first light exiting region 124*a*. The first light exiting region 124*a* connects between the concave portion 122 and the second light exiting region 124*b*.

In detail, the concave portion 122 may be symmetric corresponding to the center C1 of the bottom 126. To be more specific, the concave portion 122 may be, for example, a cone-shaped recess, wherein an apex of cone-shaped recess points toward the LED chip 110. In general, a vertex angle θ of the cone-shaped recess may range from 45 degree to 150 degree. In the present embodiment, the vertex angle θ ranges from 70 degree to 120 degree.

Referring to FIG. 2, the distance between the center C1 of the bottom 126 and the light exiting surface 124 is increasing smoothly and gradually from one end E1 where the first light exiting region 124*a* connects to the concave portion 122 to another end E2 where the first light exiting region 124*a* connects the second light exiting region 124*b*. An included angle $\theta_0$ formed from the center C1 of the bottom 126 corresponding to the end E1 and the end E2 may range from 3 degree to 70 degree. Moreover, the distance between the center C1 of the bottom 126 and the light exiting surface 124 from the end E2 to another end E3 where the second light exiting region 124*b* connects to the bottom 126 of the molding lens 120 may be increasing smoothly and gradually or decreasing. In the present embodiment, the distance between the center C1 of the bottom 126 and the light exiting surface 124 is decreasing from the end E2 to the end E3, but the present invention is not limited thereto.

Figure 3:
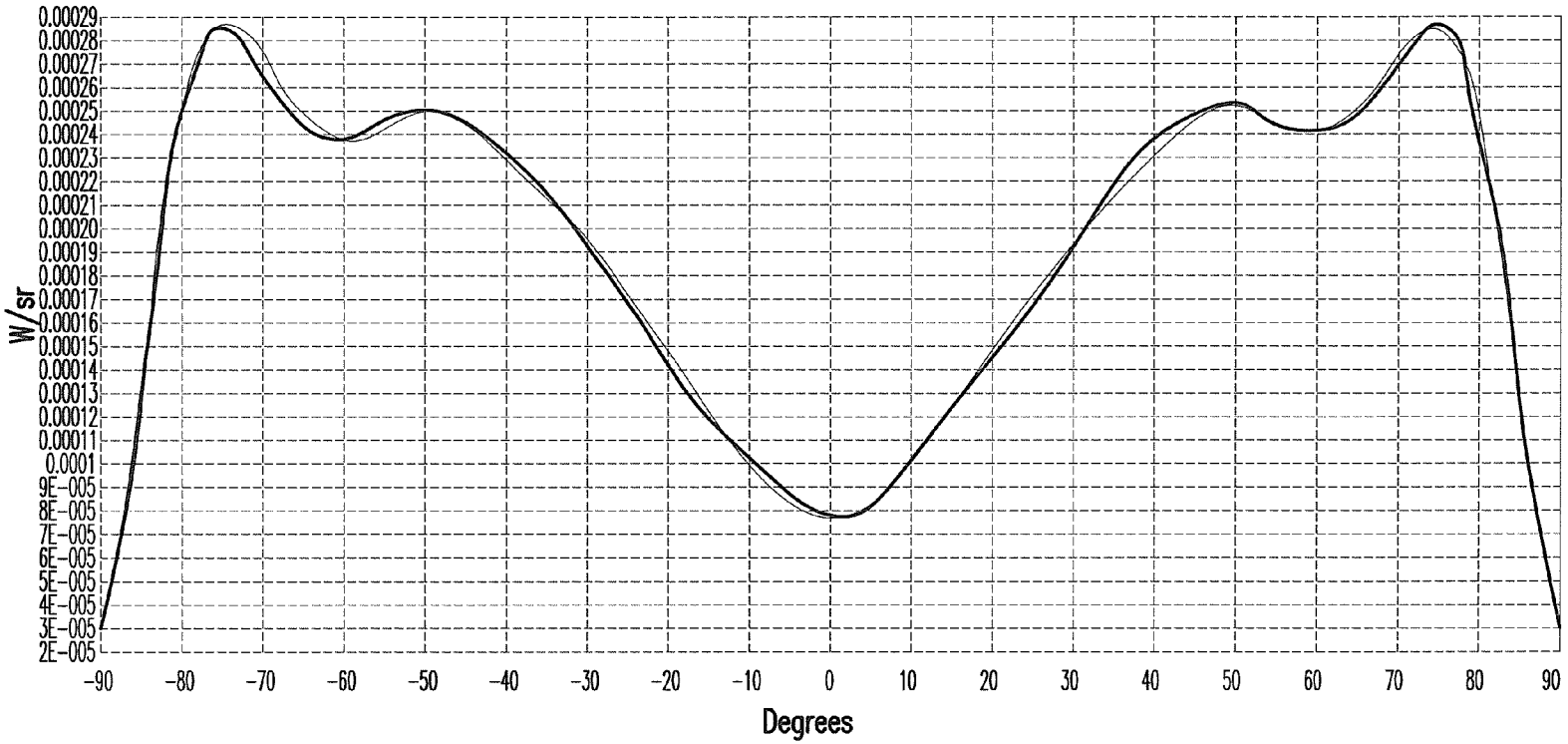
FIG. 3 illustrates an optical diagram of luminous intensity of the light source device in FIG. 1.
Figure 4:
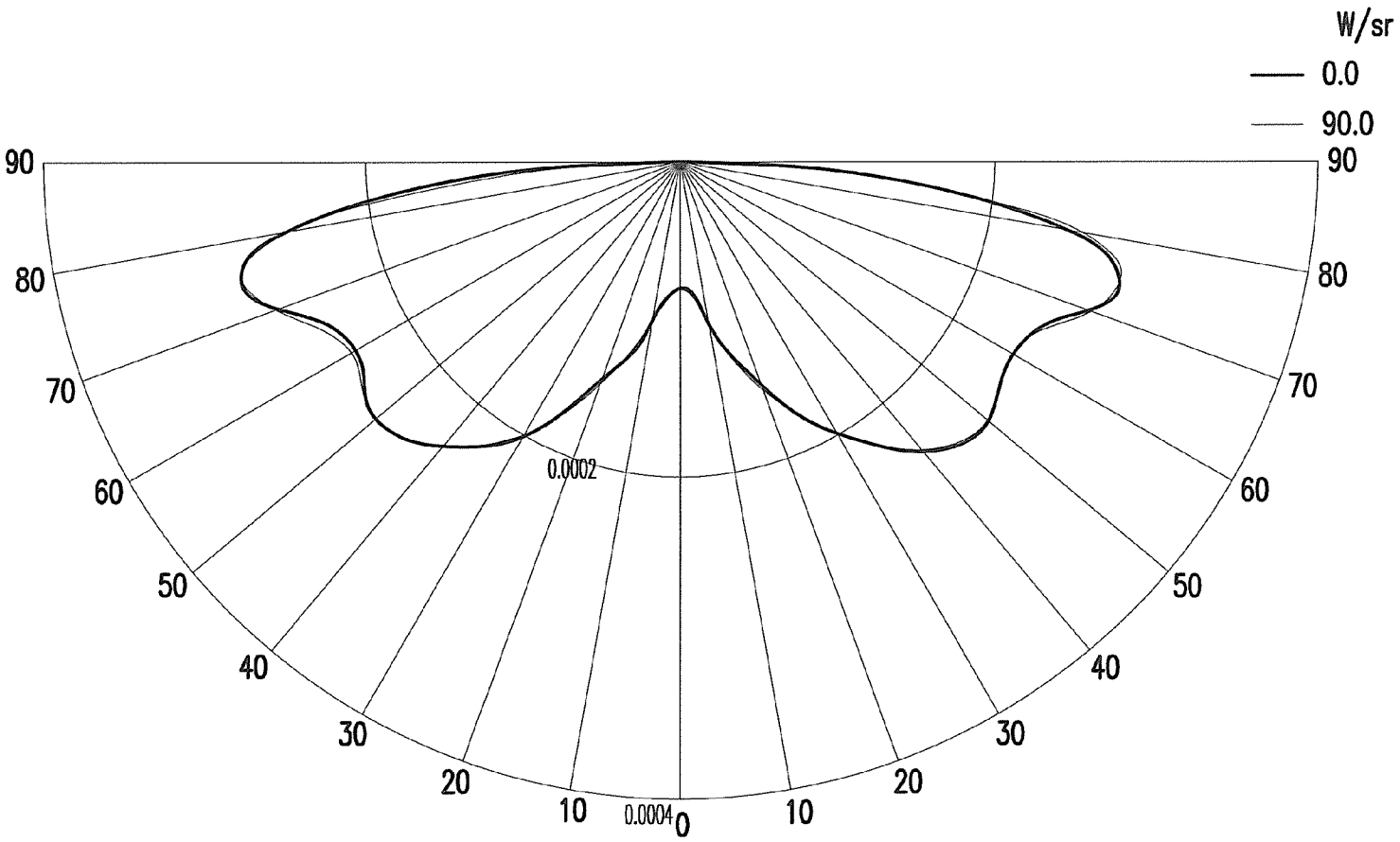
FIG. 4 illustrates a light shape distribution diagram of the light source device in FIG. 1.

FIG. 3 illustrates an optical diagram of luminous intensity of the light source device in FIG. 1. FIG. 4 illustrates a light shape distribution diagram of the light source device in FIG.

1. In the luminous intensity diagram of FIG. 3, a vertical axis represents the luminous intensities with a unit of watt per steradian (W/sr), and a horizontal axis represents angles included with the center axis of the LED chip 110. In the light shape distribution diagram of FIG. 4, a 0.0 direction drawn in thick line corresponds to a horizontal direction facing the light source device 100, a 90.0 direction drawn in think line corresponds to a vertical direction facing the light source device 100, a radial direction corresponds to a luminous intensity, and the greater the farther away from the center, the greater the luminous intensity is. Referring to FIG. 3 and FIG. 4, the luminous intensity distribution of the light source device 100 is substantially in a multimodal distribution with multiple peaks. Therefore, with the disposition of the molding lens 120, it is proved that the light source device 100 can provide wide angle light-emitting effect and great light-emitting uniformity. It should be noticed that the above value range is only used as an example, and the disclosure is not limited thereto.

FIG. 5 illustrates a schematic view of a light source device according to an embodiment of the invention. FIG. 6 illustrates a cross-sectional view of the light source device in FIG. 5. It is noted that the light source device 200 shown in FIG. 5 and FIG. 6 contains many features same as or similar to the light source device 100 disclosed earlier with FIG. 1 and FIG. 2. For purpose of clarity and simplicity, detail description of same or similar features may be omitted, and similar reference numbers are used in the drawings and the description to refer to the same or like parts.

The main differences between the light source device 200 shown in FIG. 5 and the light source device 100 in FIG. 1 are that, in the present embodiment, the concave portion 222 may include a first V-shaped valley including a first flat surface 222*a* and a second flat surface 222*b* connected to each other in a non-coplanar manner as shown in FIG. 5, and a vertex angle ($\theta_1+\theta_2$) is formed between the first flat surface 222*a* and the second flat surface 222*b* in cross section view.

In general, the vertex angle ($\theta_1+\theta_2$) may range from 45 degree to 150 degree. In the present embodiment, the vertex angle ($\theta_1+\theta_2$) ranges from 70 degree to 120 degree. In detail, the vertex angle described above includes a first vertex angle $\theta_1$ and a second vertex angle $\theta_2$, wherein the first vertex angle $\theta_1$ is formed between the first flat surface 222*a* and a vertical plane Vp, and the second vertex angle θ2 is formed between the second flat surface 222*b* and the vertical plane Vp. In the present embodiment, the concave portion 222 is asymmetric corresponding to the center C1 of the bottom 226, and the degree of the first vertex angle $\theta_1$ is different from the degree of the second vertex angle $\theta_2$. The first vertex angle may range from 20 degree to 75 degree, and the second vertex angle $\theta_2$ may also range from 20 degree to 75 degree. In the present embodiment, the first vertex angle $\theta_1$ is substantially equal to 45 degree, while the second vertex angle $\theta_2$ is substantially equal to 70 degree. It should be noticed that the above value range is only used as an example, and the disclosure is not limited thereto. Alternatively, in other embodiment, the concave portion 222 may be symmetric corresponding to the center C1 of the bottom 226. Namely, the degree of the first vertex angle $\theta_1$ is equal to the degree of the second vertex angle $\theta_2$.

Figure 7:
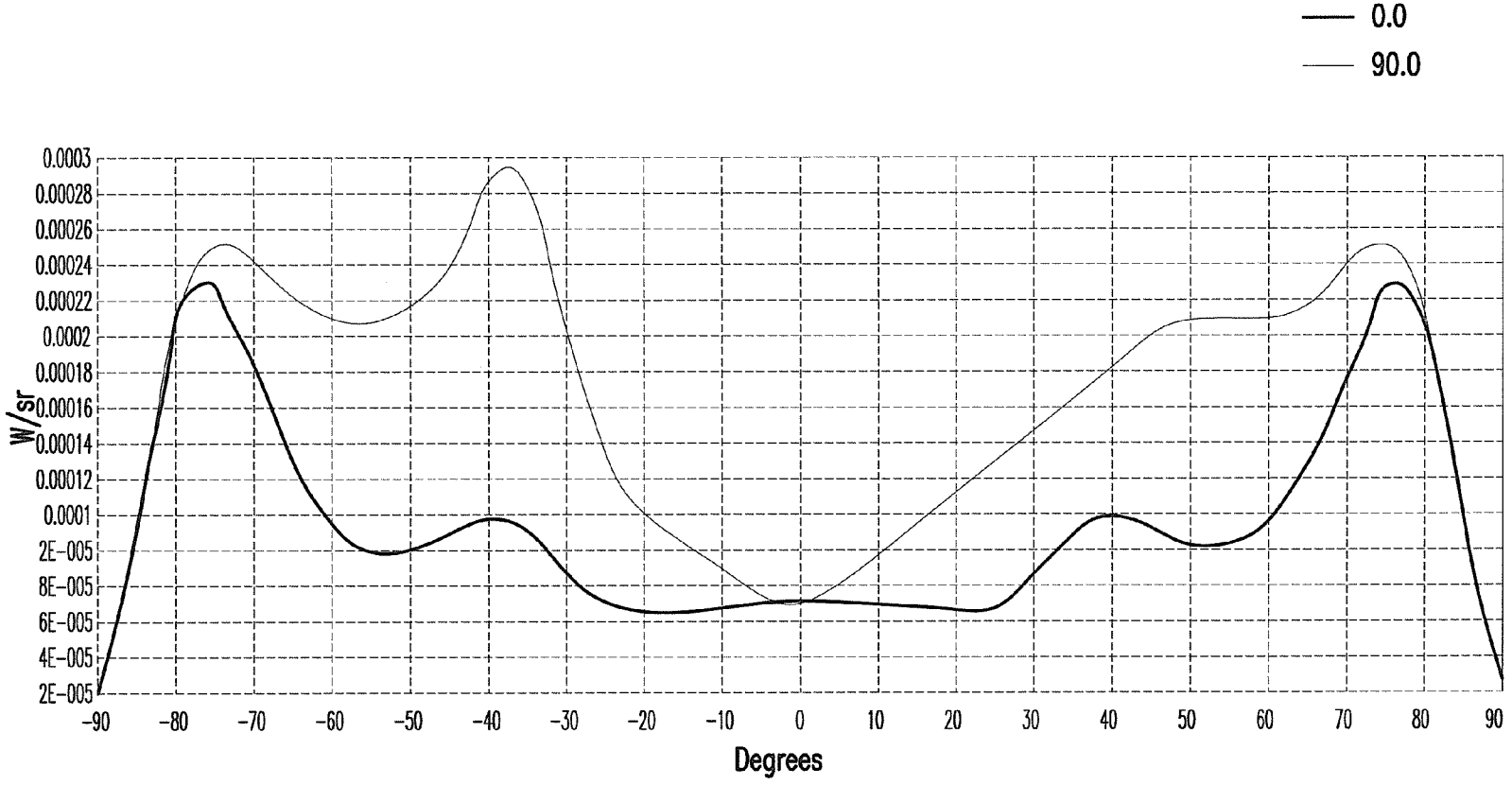
FIG. 7 illustrates an optical diagram of luminous intensity of the light source device in FIG. 5.
Figure 8:
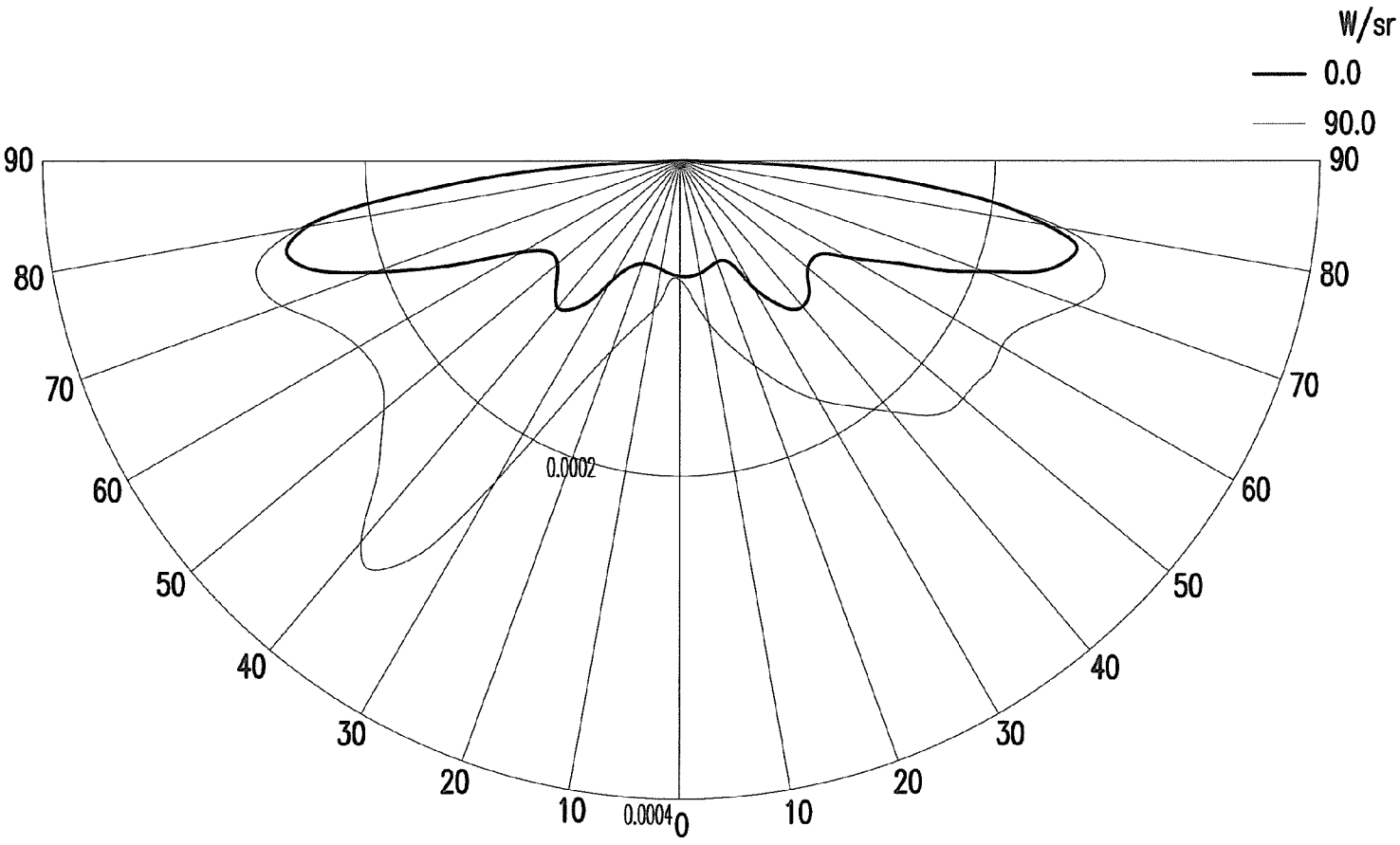
FIG. 8 illustrates a light shape distribution diagram of the light source device in FIG. 5.

FIG. 7 illustrates an optical diagram of luminous intensity of the light source device in FIG. 5. FIG. 8 illustrates a light shape distribution diagram of the light source device in FIG. 5. In the luminous intensity diagram of FIG. 7, similar to FIG. 3, a vertical axis represents the luminous intensities with a unit of watt per steradian (W/sr), and a horizontal axis represents angles included with the center axis of the LED chip 210. In the light shape distribution diagram of FIG. 8, similar to FIG. 4, a 0.0 direction drawn in thick line corresponds to a horizontal direction facing the light source device 200, a 90.0 direction drawn in thin line corresponds to a vertical direction facing the light source device 200, a radial direction corresponds to a luminous intensity, and the greater the farther away from the center, the greater the luminous intensity is. Referring to FIG. 7 and FIG. 8, it is seen that the luminous intensity distribution of the light source device 200 is substantially in a multimodal distribution with multiple mild peaks. Therefore, with the disposition of the molding lens 220, the light source device 200 can provide wide angle light-emitting effect and great light-emitting uniformity.

Figure 9:
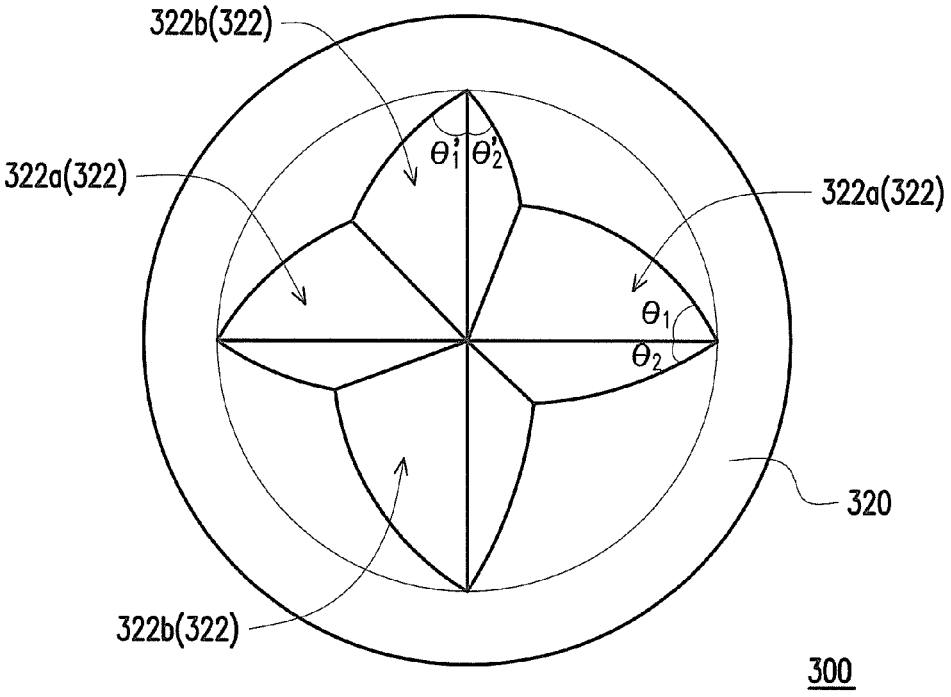
FIG. 9 illustrates a top view of a light source device according to an embodiment of the invention.

FIG. 9 illustrates a top view of a light source device according to an embodiment of the invention. FIG. 10 illustrates a schematic view of the light source device in FIG. 9. It is noted that the light source device 300 shown in FIG. 9 and FIG. 10 contains many features same as or similar to the light source device 200 disclosed earlier with FIG. 5 and FIG. 6. For purpose of clarity and simplicity, detail description of same or similar features may be omitted, and similar reference numbers are used in the drawings and the description to refer to the same or like parts.

The main differences between the light source device 300 shown in FIG. 9 and the light source device 200 shown in FIG. 5 are that the concave portion 322 not only includes a first V-shaped valley 322*a*, but also includes a second V-shaped valley 322*b* intersected with the first V-shaped valley 322*a*. In detail, the vertex angle of the first V-shaped valley 322*a* may include a first vertex angle $\theta_1$ and a second vertex angle $\theta_2$ as shown in FIG. 9. In the present embodiment, the degree of the first vertex angle $\theta_1$ may be different from the degree of the second vertex angle $\theta_2$. Similarly, the vertex angle of the second V-shaped valley 322*b* may include a third vertex angle $\theta_1'$ and a fourth vertex angle $\theta_2'$ as shown in FIG. 9, and the degree of the third vertex angle $\theta_1'$ may be different from the degree of the fourth vertex angle $\theta_2'$. In the present embodiment, the shape of the first V-shaped valley 322*a* is different from the shape of the second V-shaped valley 322*b*, which means the first vertex angle $\theta_1$, the second vertex angle $\theta_2$, the third vertex angle $\theta_1'$ and the fourth vertex angle $\theta_2'$ may be different from one another. It should be noticed that the abovementioned embodiment is only used as an example, and the disclosure is not limited thereto. Alternatively, in other embodiment, the concave portion 322 may be symmetric. Namely, the degrees of the first vertex angle $\theta_1$, the second vertex angle $\theta_2$, the third vertex angle $\theta_1'$ and the fourth vertex angle $\theta_2'$ are all the same, or some of the vertex angles are the same, and some of the vertex angles are different. The invention is not limited thereto.

Figure 11:
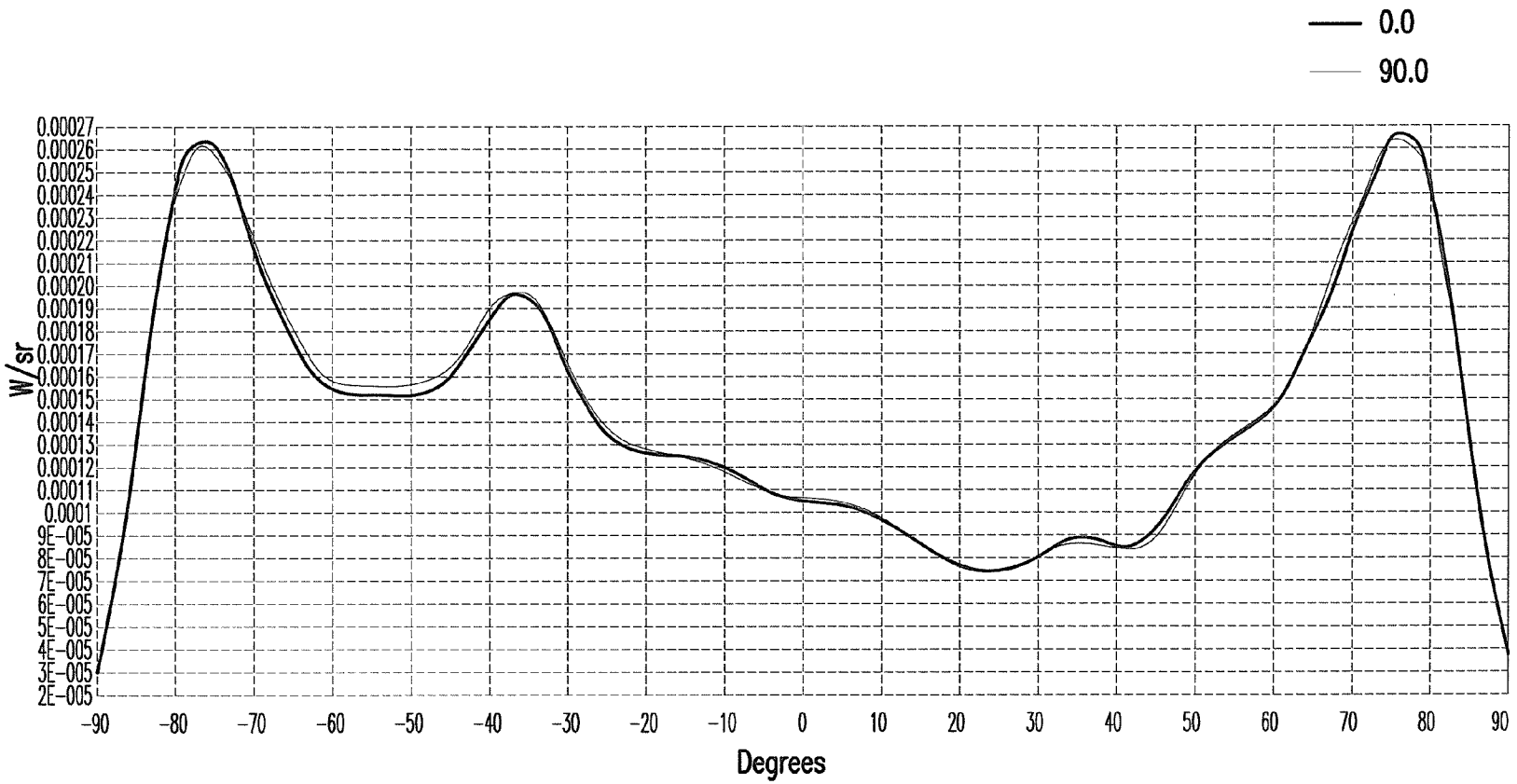
FIG. 11 illustrates an optical diagram of luminous intensity of the light source device in FIG. 9.
Figure 12:
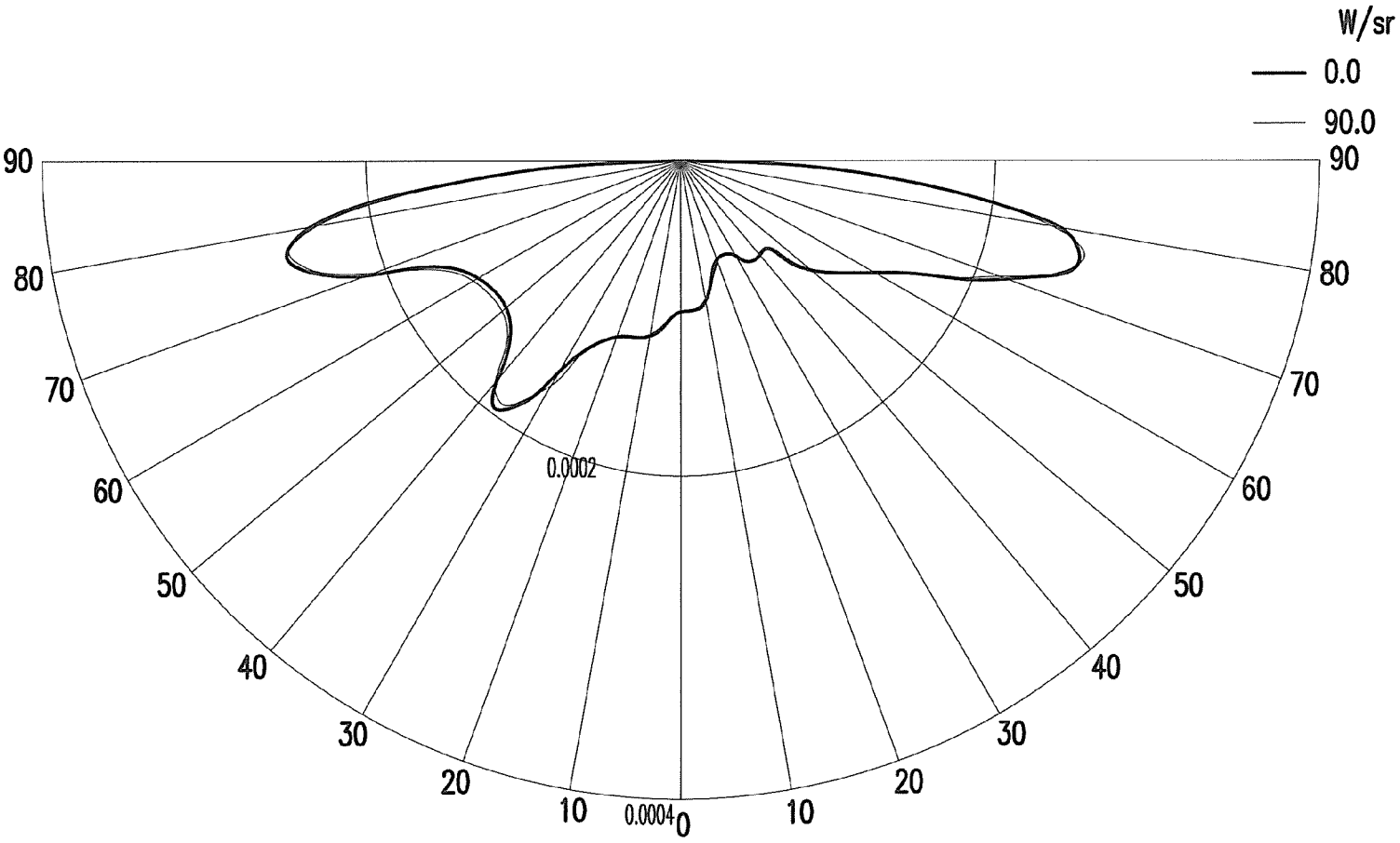
FIG. 12 illustrates a light shape distribution diagram of the light source device in FIG. 9.

FIG. 11 illustrates an optical diagram of luminous intensity of the light source device in FIG. 9. FIG. 12 illustrates a light shape distribution diagram of the light source device in FIG. 9. In the luminous intensity diagram of FIG. 11, similar to FIG. 3 and FIG. 7, the vertical axis in FIG. 11 represents the luminous intensities with a unit of watt per steradian (W/sr), and the horizontal axis represents angles included with the center axis of the LED chip. In the light shape distribution diagram of FIG. 12, similar to FIG. 4 and FIG. 8, a 0.0 direction drawn in thick line corresponds to a horizontal direction facing the light source device 300, a 90.0 direction drawn in thin line corresponds to a vertical direction facing the light source device 300, the radial direction corresponds to a luminous intensity, and the greater the farther away from the center, the greater the luminous intensity is. Referring to FIG. 11 and FIG. 12, it is seen that the luminous intensity distribution of the light source device 300 is substantially in a multimodal distribution with multiple mild peaks. Therefore, with the disposition of the molding lens 320, the light source device 300 can provide wide angle light-emitting effect and great light-emitting uniformity.

FIG. 13 illustrates a cross-sectional view of a light source device according to an embodiment of the invention. It is noted that the light source device 400 shown in FIG. 13 contains many features same as or similar to the light source device 100 disclosed earlier with FIG. 1. For purpose of clarity and simplicity, detail description of same or similar features may be omitted, and similar reference numbers are used in the drawings and the description to refer to the same or like parts.

The main differences between the light source device 400 shown in FIG. 13 and the light source device 100 shown in FIG. 1 are that the concave portion 422 includes a valley-shaped recess in cross section view, and the valley-shaped recess includes a first curved surface 422*a* and a second curved surface 422*b* connected to each other in a non-coplanar manner. The first curved surface 422*a* and the second curved surface 422*b* protrudes away from the bottom 426 of the molding lens 420. The first light exiting region and the second light exiting region of the light exiting surface 424 are coplanar with each other and the light exiting surface 424 is vertical corresponding to the bottom 426 of the molding lens 420. An included angle $\theta_0$ formed from the center of the bottom 426 corresponding to one end E1 where the first light exiting region of the light exiting surface 424 connects to the concave region 422 and another end E3 where the second light exiting region of the light exiting surface 424 connects to the bottom 426 of the molding lens 420 may be range from 40 degree to 50 degree. With the disposition of the molding lens 420, the light paths illustrated in FIG. 13 shows that the light source device 400 may also provide wide angle light-emitting effect and great light-emitting uniformity.

In sum, the present invention provides various molding lenses with various shapes for encapsulating the LED chip of the light source device. The light exiting surface of the molding lens includes a concave portion, a first light exiting region surrounding the concave portion and a second light exiting region surrounding the first light exiting region, and the first light exiting region connects between the concave portion and the second light exiting region. The concave portion is capable of reflecting the light emitted by the LED chip to the first light exiting region and the second light exiting region. Thereby, with the disposition of the molding lens, the light source device can provide wide angle light-emitting effect and great light-emitting uniformity.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A light source device, comprising:

a light emitting diode (LED) chip; and a molding lens, which is directly formed on the LED chip, comprising a center of a bottom where the LED chip located at and a light exiting surface formed corresponding to the center;

wherein the light exiting surface comprises a concave portion, a first light exiting region surrounding the concave portion and a second light exiting region surrounding the first light exiting region, and the first light exiting region connects between the concave portion and the second light exiting region, wherein the concave portion comprises a first V-shaped valley comprising a first flat surface and a second flat surface connected to each other in a non-coplanar manner, and a vertex angle is formed between the first flat surface and the second flat surface in cross section view, wherein the vertex angle comprises a first vertex angle formed between the first flat surface and a vertical plane, and a second vertex angle formed between the second flat surface and the vertical plane, wherein the concave portion is symmetric corresponding to the center of the bottom, and the degree of the first vertex angle is equal to the degree of the second vertex angle, wherein the concave portion further comprises a second V-shaped valley intersected with the first V-shaped valley.

2. The light source device as claimed in claim 1, wherein the vertex angle ranges from 45 degree to 150 degree.

3. The light source device as claimed in claim 2, wherein the vertex angle ranges from 70 degree to 120 degree.

4. The light source device as claimed in claim 1, wherein the first vertex angle ranges from 20 degree to 75 degree.

5. The light source device as claimed in claim 4, wherein the first vertex angle is substantially equal to 45 degree.

6. The light source device as claimed in claim 1, wherein the second vertex angle ranges from 20 degree to 75 degree.

7. The light source device as claimed in claim 6, wherein the second vertex angle is substantially equal to 70 degree.

8. The light source device as claimed in claim 1, wherein the first light exiting region comprises a curve.

9. The light source device as claimed in claim 1, wherein an included angle formed from the center of the bottom corresponding to one end where the first light exiting region connects to the concave portion and another end where the first light exiting region connects to the second light exiting region ranges from 3 degree to 70 degree.

10. The light source device as claimed in claim 1, wherein the second light exiting region of the light exiting surface is vertical corresponding to the bottom of the molding lens.

11. A light source device, comprising:

a light emitting diode (LED) chip; and a molding lens, which is directly formed on the LED chip, comprising a center of a bottom where the LED chip located at a light exiting surface formed corresponding to the center;

wherein the light exiting surface comprises a concave portion, a first light exiting region surrounding the concave portion and a second light exiting region surrounding the first light exiting region, and the first light exiting region connects between the concave portion and the second light exiting region, wherein the concave portion comprises a first V-shaped valley comprising a first flat surface and a second flat surface connected to each other in a non-coplanar manner, and a vertex angle is formed between the first flat surface and the second flat surface in cross section view, wherein the vertex angle comprises a first vertex angle formed between the first flat surface and a vertical plane, and a second vertex angle formed between the second flat surface and the vertical plane, wherein the concave portion is asymmetric corresponding to the center of the bottom, and the degree of the first vertex angle is different from the degree of the second vertex angle.

12. The light source device as claimed in claim 11, wherein the concave portion further comprises a second V-shaped valley intersected with the first V-shaped valley.

13. The light source device as claimed in claim 12, wherein the shape of the first V-shaped valley is different from the shape of the second V-shaped valley.

14. The light source device as claimed in claim 11, wherein the first light exiting region comprises a curve.

15. The light source device as claimed in claim 11, wherein the second light exiting region of the light exiting surface is vertical corresponding to the bottom of the molding lens.

16. A light source device, comprising:

a light emitting diode (LED) chip; and a molding lens, which is directly formed on the LED chip, comprising a center of a bottom where the LED chip located at and a light exiting surface formed corresponding to the center;

wherein the light exiting surface comprises a concave portion, a first light exiting region surrounding the concave portion and a second light exiting region surrounding the first light exiting region, and the first light exiting region connects between the concave portion and the second light exiting region, wherein the concave portion comprises a valley-shaped recess in cross section view, and the valley-shaped recess comprises a first curved surface and a second curved surface connected to each other in a non-coplanar manner, the first curved surface and the second curved surface protrude away from the bottom, wherein the first light exiting region and the second light exiting region of the light exiting surface are vertical corresponding to the bottom of the molding lens, wherein an included angle formed from the center of the bottom corresponding to one end where the first light exiting region connects to the concave region and another end where the second light exiting region connects to the bottom of the molding lens ranges from 40 degree to 50 degree.

* * * * *